US005241357A

United States Patent [19]

Iwata

[11] Patent Number: 5,241,357

[45] Date of Patent: Aug. 31, 1993

[54] COLOR IMAGE FORMING EQUIPMENT WITH TWO DEVELOPERS AND A PULSE BIAS

[75] Inventor: Naoki Iwata, Tokyo, Japan

[73] Assignee: Ricoh Company, Ltd., Tokyo, Japan

[21] Appl. No.: 770,933

[22] Filed: Oct. 4, 1991

[30] Foreign Application Priority Data

Oct. 5, 1990 [JP] Japan ..... 2-268011

[51] Int. Cl.[5] ..... G03G 15/01

[52] U.S. Cl. ..... 355/326; 118/645; 355/251

[58] Field of Search ..... 355/251, 253, 245, 246, 355/326, 327, 208; 118/645, 656-658; 430/42, 45, 126, 100

[56] References Cited

U.S. PATENT DOCUMENTS 4,674,857 6/1987 Satomura et al. .
4,937,629 6/1990 Maruyama et al. ..... 355/265
4,937,630 6/1990 Yoshikawa et al. ..... 355/273
4,947,200 8/1990 Kumasaka et al. ..... 355/251
4,947,212 8/1990 Ikegawa et al. ..... 355/265
4,947,215 8/1990 Chuang ..... 355/274
4,959,286 9/1990 Tabb ..... 355/326
5,066,979 11/1991 Goto et al. ..... 355/245 X

*Primary Examiner*—A. T. Grimley
*Assistant Examiner*—T. A. Dang
*Attorney, Agent, or Firm*—Oblon, Spivak, McClelland, Maier & Neustadt

[57] ABSTRACT

Color image forming equipment for transferring a multicolor image from a photoconductive element to a recording medium by a single transfer. A pulse bias is applied as a bias for development. The development in the second and successive colors is implemented by non-contact development using a thin layer of non-magnetic single-component toner. The toner for effecting the development the second and successive colors has the same polarity as an electrostatic latent image.

10 Claims, 3 Drawing Sheets

COLOR IMAGE FORMING EQUIPMENT WITH TWO DEVELOPERS AND A PULSE BIAS

BACKGROUND OF THE INVENTION

The present invention relates to a copier, facsimile apparatus, printer or similar image forming equipment capable of producing a multicolor image and, more particularly, to color image forming equipment of the type forming a multicolor image on an image carrier and then transferring it to a recording medium.

Image forming equipment of the type repeating charging, exposure and development with an image carrier to form a multicolor image on the image carrier and then transferring it to a recording medium by a single transfer has been proposed in various forms in the past.

For example, Japanese Patent Laid-Open Publication No. 60471/1988 discloses image forming equipment which has a plurality of developing means arranged around an image carrier to produce a multicolor image. Developing means located at the downstream side uses a toner opposite in polarity to the toner of the preceding or upstream developing means. A toner layer for development in the succeeding or downstream developing means does not contact the image carrier. While an AC electric field for depositing the toner is applied when the succeeding developing means is in operation, an electric field for depositing the toner of the preceding developing means is applied when the succeeding development means is not operated. The toner layer in the succeeding developing means is selected to be 30 μm to 500 μm thick. The preceding developing means is loaded with a two-component developer containing a toner of chromatic color, while the succeeding developing means is loaded with a one-component developer implemented as a black toner.

Japanese Patent Laid-Open Publication No. 63061/1988 teaches an image recording method using a photoconductive element having a 35 μm to 90 μm thick photoconductive layer made of selenium or arsenic selenade and having a capacitance of 20 pF to 170 pF. A plurality of developing means are arranged around the photoconductive element. The equipment performs charging, exposure and development a plurality of times to form color images on the same photoconductive element. Each developing means is spaced apart by less than 250 μm from the photoconductive element. During development, a thin toner layer does not contact the photoconductive element, and a DC bias for development is applied. The photoconductive element has a 15 μm to 50 μm thick organic photocondutive layer. The equipment effects reversal development. The image portion and a non-image portion have a potential contrast higher than 400 V. The thickness of a toner layer formed on the photoconductive element by development in one color ranges from 5 μm to 30 μm. The surface of the photoconductive element is charged by a scorotron charger.

Further, Japanese Patent Laid-Open Publication 85578/1988 proposes image forming equipment in which a plurality of developing means are located to face a recording medium without contacting the later so as to produce a multicolor image. The first developing means located at the upstream side is rotated in the same direction as and at a higher speed than the recording medium, and it is assigned to development in black. A DC-biased AC bias is applied to the first developing means. The second and successive developing means downstream of the first developing means each effects equispeed development in color and is applied with a DC bias only.

When a multicolor image is to be formed on an image carrier, the developments in the second and successive colors are implemented as non-contact developments. Preferably, use should be made of an image forming system using a non-magnetic toner to facilitate color image formation, especially a single-component system which promotes a miniature and inexpensive configuration. The one-component system effects development by causing a toner layer to face an image carrier without contacting the latter. In the event of development in second color, a toner image has already been formed on the image carrier. Hence, should an AC bias be applied as a bias for development a in Japanese Patent Laid-Open Publication No. 60471/1988, the toner would move back and forth between the latent image surface and the surface of the toner carrier. This not only disturbs the toner image of first color but also causes the toner of first color to enter the developing means loaded with a toner of second color to thereby render the latter impure.

To eliminate the above problem, the developments in the second and successive colors may cause a non-magnetic toner to fly by a DC electric field, as taught by the Japanese Patent Laid-Open Publication Nos. 63061/1988 and 85578/1988. However, a toner layer cannot be transferred by a DC electric field unless the charge of the toner is controlled to be small enough to orient the electric field acting on the toner layer such that it causes the toner to fly. From the efficient flight standpoint, a toner layer whose amount of charge is less than 5 μC/g as measured by a suction method. However, a toner with such a small amount of charge does not fly faithfully along the electric field, reducing the clear-cutness of the resulting image.

Another problem with the fight flight relying on an DC electric field is that the toner does not fly until an electric field causing the toner to begin to fly, i.e., a threshold electric field, has been developed in a developing region. Since the toner layer suddenly begins to fly at the threshold electric field, the resulting image suffers from a poor gamma characteristic, i.e., it loses portions of low contrasts.

Further, the electrostatic restraint acting on the toner with a small amount of charge is weak and, therefore, causes it to be scattered around to smear the interior of the equipment.

The adequate range of Q/M of a toner for development is 5 μC/g to 30 μC/g. To cause a toner with such a strong mirror image force to fly, it is necessary that the van der waals' forces acting on the toner carrier surface together with the mirror image force be reduced. Then, the degree of cohesion of the toner has to be confined in the range of 5% to 30%. This, however, allows the toner to move easily on the toner carrier and makes it difficult to form two or more toner layers. When development is effected with a single toner layer being moved at substantially the same speed as a latent image, the resulting image density if low. Should the speed ratio be doubled or tripled, the density would be higher at the trailing edge of the resulting image than at the leading edge. Such an irregular density distribution is espetially critical from the tonal aspect when it comes to a color image.

SUMMARY OF THE INVENTION

It is, therefore, an object of the present invention to provide color image forming equipment of the type forming toner images of two or more colors one upon another on an image carrier and capable of eliminating the above-discussed various problems particular to conventional equipment by adequately combining the bias and the amount of charge of toner for the second and successive developments.

It is another object of the present invention to provide color image forming equipment of the type described which is capable of eliminating the above-discussed drawbacks by an optimal combination of the amount of charge and the degree of cohesion of a toner for any of the second and successive developments, the toner carrier and the bias.

A color image forming equipment for transferring a multicolor image from an image carrier to a recording medium by a single transfer of the present invention comprises a first exposing device for electrostatically forming a first latent image on the image carrier, a first developing device for developing the first latent image, a second exposing device for electrostatically forming a second latent image on the image carrier carrying a toner image produced by the first developing device, and a second developing device comprising a toner carrier for developing the second latent image. The second exposing device effects development without contacting the image carrier and by use of a non-magnetic one-component toner layer formed on the toner carrier. A pulse bias is applied to the second developing device as a bias for development.

BRIEF DESCRIPTION OF THE DRAWINGS

The above and other objects, features and advantages o the present invention will become more apparent from th following detailed description taken with the accompanying drawings in which.

DESCRIPTION OF THE PREFERRED EMBODIMENTS

Figure 1:
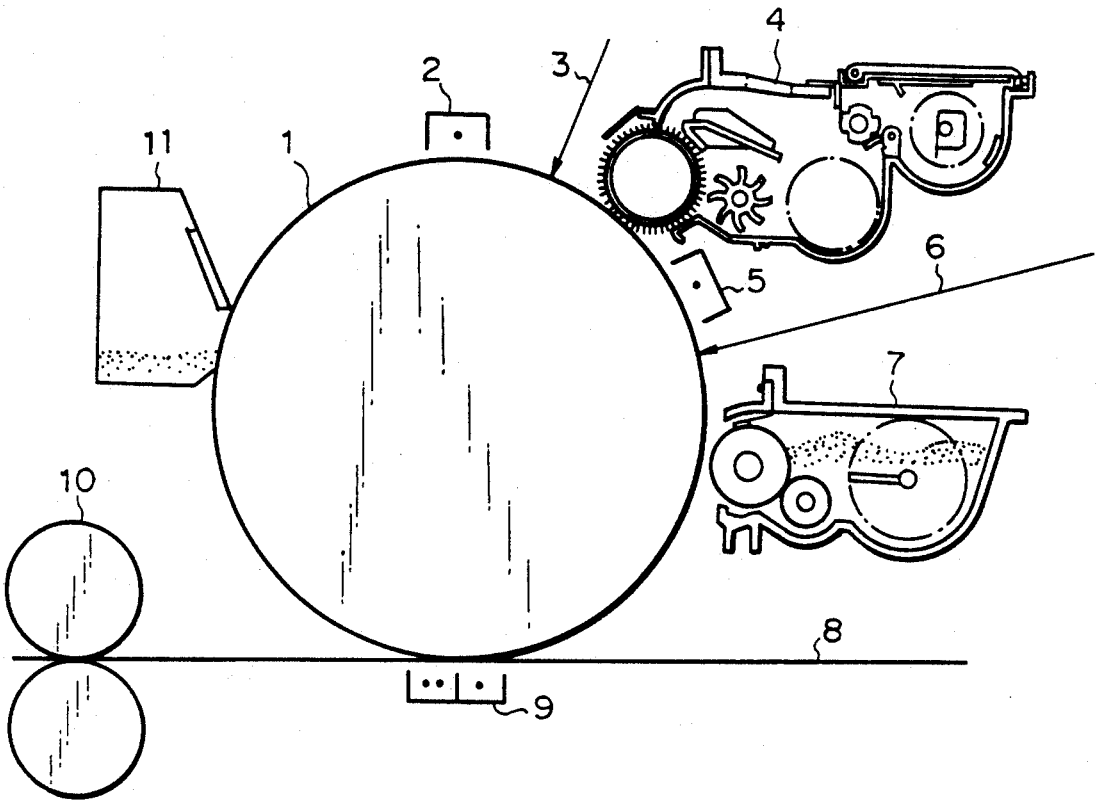
FIG. 1 is a view of image forming equipment to which a preferred embodiment of the present invention is applied.

Referring to FIG. 1 of the drawings, image forming equipment to which a preferred embodiment of the present invention is applied is shown and includes a photoconductive element in the form of a drum 1. Arranged around the drum 1 are a first charger 2, a first exposing device 3, a first development device 4, a second charger 5, a second exposing device 6, a second developing device 7, a transport path 8 for transporting a paper sheet or similar recording medium, a transfer charger 9, a fixing device 10, and a cleaning device 11.

After the first charger 2 has charged the surface of the drum 1, the first exposing device 3 electrostatically forms a latent image on the drum 1. The first developing device 4 develops the latent image on the drum 1 to produce a first toner image. While the developing device 4 may of any desired type, the illustrative embodiment uses a contact type developing system implemented with a magnetic brush of a two-component developer containing a magnetic or non-magnetic toner. Subsequently, the second charger 5 charges the drum 1 again from above the first toner image of particular color. As a result, the area of the drum 1 having undergone the exposure and the surrounding area are equalized in potential. Then, the second exposing device 6 electrostatically forms a second latent image on the drum 1. At this instant, if the area of the drum 1 where the toner of first color is deposited is not exposed by the second exposing device 6, the toners of first and second colors will not be mixed together. Thereafter, the second developing device 7 develops the second latent image to produce a second toner image. The second developing unit 7 should preferably be implemented with a non-magnetic toner which is feasible for color reproduction, especially a one-component, non-contact type developing system which enhances a miniature and inexpensive construction.

By the procedure described above, a multicolor image developed in two or more colors is formed on the drum 1. The transfer charger 9 transfers the multicolor image to a recording medium being transported on the transport path 8 by a single transfer. The toner image so transferred to the recording medium is fixed by the fixing device 10. Toner particles remaining on the drum 1 after the image transfer are removed by the cleaning device 11, preparing the drum 1 for another image forming cycle.

How the non-contact type development is performed in the second and successive colors will be described hereinafter.

Figure 2:
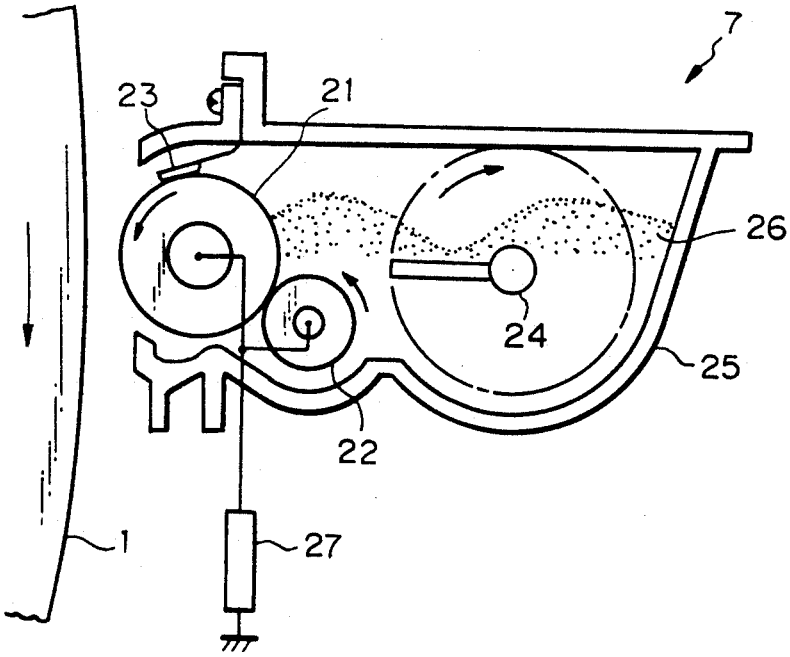
FIG. 2 is a view showing a specific construction of a second developing device included in the embodiment.

FIG. 2 shows a specific construction of the second developing device 7 using a non-magnetic single-component developer, i.e., toner. As shown, the developing device 7 has a hopper 25 accommodating an agitator 24 therein. A toner 26 whose color is different from the first color is stored in the hopper 25 and agitated by the agitator 24. As the toner 26 is handed over from the agitator 24 to a supply member 22, it deposits on a toner carrier in the form of a developing roller or toner carrier roller 21 due to the friction thereof with the roller 21. A regulating member 23 regulates the toner deposited on the developing roller 21 to a predetermined thickness before the toner reaches a developing region. The toner layer on the developing roller 21 and the drum 1 move at substantially the same speed without contacting each other. The prerequisite is that the developing roller 21 be prevented from disturbing the toner image of first color having been formed on the drum 1. Therefore, the developing roller 21 should be spaced apart from the drum 1 by 0.05 mm to 0.5 mm, preferably 0.1 mm to 0.2 mm. In the event of development, a bias is applied from a power source 27, as illustrated. When the image carrier or drum 1 is constituted by an organic photoconductor which charges to negative polarity, the potential of the toner image of first color will be −700 V to −900 V, the potential of the latent image representative of second color will be about −100 V, and the background potential will be about −800 V. The bias for development should be selected such that the toner of first color does not fly into the developing device 7 and, yet, the non-magnetic toner desirably flies toward the latent image of second color.

Figure 3:
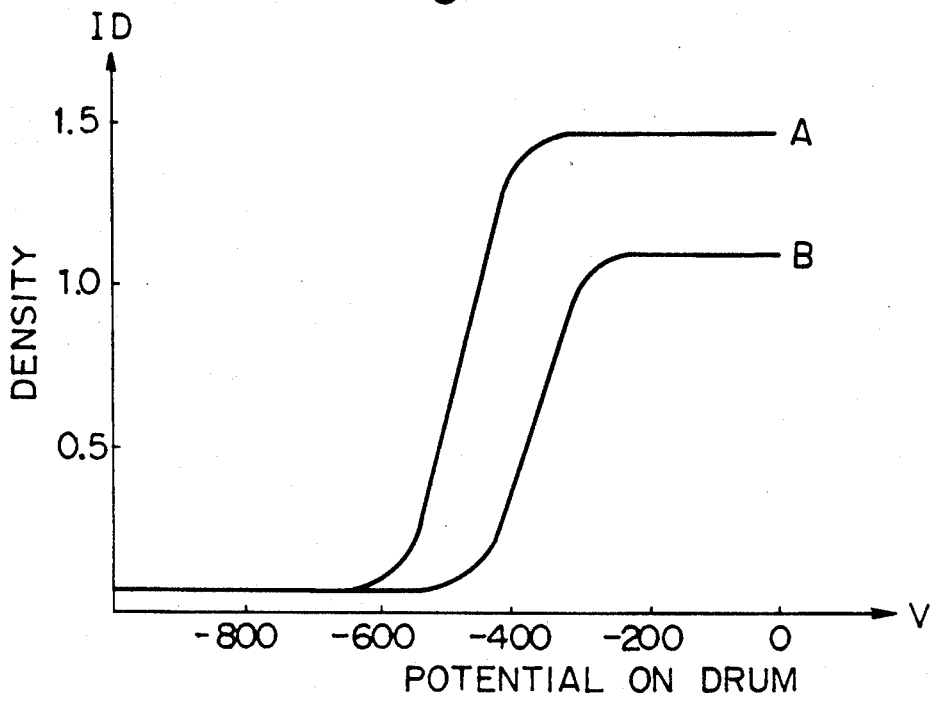
FIGS. 3 and 4 are graphs showing how the gamma characteristic for development changes with the bias and the charge of toner when a toner layer should flay for development.

Assuming that a DC bias of −800 V is applied for development which uses the non-magnetic toner, the development gamma characteristic changes with the amount of charge of the toner layer, as shown in FIG. 3. The amount of charge of the toner layer formed on the developing roller 21 is measured by a suction method, i.e., by sucking about 10 mg of toner in an about 30 g Faraday gauge. In FIG. 3, a curve A indicates the result of measurement particular to a toner whose amount of charge per unit mass (Q/M) is −3 μC/G, while a curve B indicates the result of measurement particular to a toner whose Q/M is −12 μC/g. As FIG. 3 indicates, the toner with Q/M of −3 μC/g is sufficient in image density but not sufficient in the sharpness of lines, while the toner with Q/M of −12 μC/g is not sufficient in image density. It follows that when the toner of first color is prevented from flying into the developing of second color by a DC electric field, a desirable image is not achievable in the second color. To eliminate this problem, the bias for the second color may be implemented as a DC-superposed AC bias. For example, when a DC voltage of −500 V is superposed on an AC voltage having a voltage of 800 V peak-to-peak and a frequency of 1000 Hz, it is possible to substantially prevent the toner of first color from flying into the developing device 7 while insuring the flight of the toner layer whose Q/M is −12 μC/g. In this case, however, the development gamma characteristic changes as represented by a curve A in FIG. 4. As the curve A of FIG. 4 indicates, an ordinary sinusoidal AC voltage fails to cause the non-magnetic toner layer to fly in matching relation to the field strength, preventing a desirable image from being produced.

Figure 4:
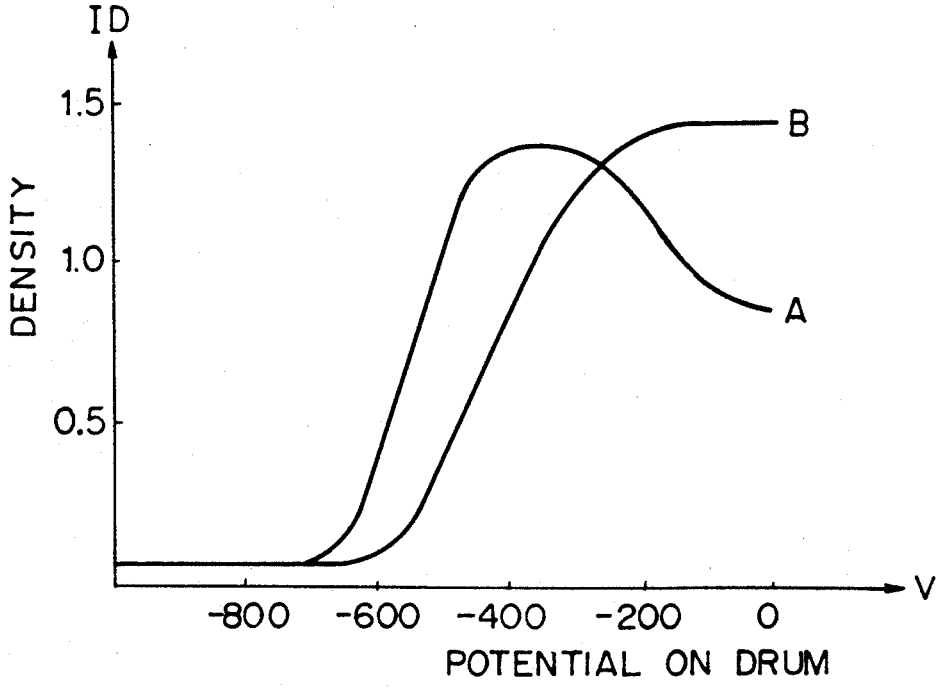

In light of the above, the illustrative embodiment effects the non-contact type development in the second and successive colors by use of a DC-superposed pulse bias. Specifically, the pulse voltage is made up of an upper voltage range of 0 V to −500 V and a lower voltage range of −500 V to −2000 V, and the duration which the lower voltage range occupies in one period is selected to be less than 40%, preferably about 30%. The frequency f is selected to range from 300 Hz to 2000 Hz, preferably 700 Hz to 1200 Hz. Voltages about 0 V would cause the toner of first color to fly, and voltages below −2000 V might cause a discharge to occur between the developing roller 21 and the drum 1. When the frequency lies in the above-mentioned range of 300 Hz to 2000 Hz, a non-magnetic toner with Q/M of −5 μC/g to −30 μC/g can successfully fly since various forces restraining the toner, e.g., the mirror image forces and van der Waals' forces, are reduced. If the lower voltage range occupies only less than 40% of one period of pulse bias, preferably about 30%, a gamma characteristic represented by a curve B in FIG. 4 is attainable. This allows the non-magnetic toner to fly in matching relation to the field strength and thereby insures the faithful reproducing of an image. In addition, the toner layer whose Q/M is −12 μC/g provides a reproduction with clear-cutness. When the toner and photoconductive element are positively charged, the above-mentioned pulse bias may be provided with a symmetrical pattern with respect to the ground potential.

More specifically, in the equipment shown in FIGS. 1 and 2, the photoconductive drum 1 is implemented with an organic photoconductor while the development in black, or first color, by the first developing device 4 is implemented by a magnetic brush. The second charger 5 charges the drum 1 on which a black toner image has been formed, then the second exposing device 6 forms a second electrostatic latent image, and then the second developing device 7 develops the latent image in a second color. At this instant, the drum potential in the area where the black toner is deposited is −705 V, the potential in the background is −800 V, and the potential in the exposed area is −100 V. The drum 1 and toner carrier roller 21 are moved at the same linear velocity of 120 mm/sec. The non-magnetic toner layer for the development in the second color has Q/M of −15 μC/g and is deposited on the roller 21 by an amount per unit area, M/A, of 1.2 mg/cm$^2$. The gap between the toner carrier roller 21 and the drum 1 is selected to be 0.16 mm. The pulse bias is made up of a portion in which −400 V occupies 1.0 msec per period and a portion in which −1200 V occupies 0.5 msec, the frequency being substantially 670 Hz. Experiments proved that such conditions are successful in preventing the toner of first color from flying into the developing device 7 and in depositing the toner of second color in a desirable manner.

Hereinafter will be described a non-contact type developing system for the second and successive colors with which an alternative embodiment of the present invention is practicable. The alternative embodiment is also implemented with the second developing device shown in FIG. 2. The developing device 7 has the hopper 25 accommodating the agitator 24 therein. The toner 26 whose color is different from the first color is stored in the hopper 25 and agitated by the agitator 24. As the toner 26 is handed over from the agitator 24 to the supply member 22, it deposits on the developing roller or toner carrier roller 21 due to the friction thereof with the roller 21. The regulating member 23 regulates the toner deposited on the developing roller 21 to a predetermined thickness before the toner reaches a developing region. The toner layer on the developing roller 21 and the drum 1 move at substantially the same speed without contacting each other. The prerequisite is that the developing roller 21 be prevented from disturbing the toner image of first color having been formed on the drum 1. Therefore, the developing roller 21 should be spaced apart from the drum 1 by 0.05 mm to 0.5 mm, preferably 0.1 mm to 0.2 mm. In the event of development, a bias is applied from the power source 27, as illustrated.

When the image carrier or drum 1 is constituted by an organic photoconductor which charges to negative polarity, the potential of the toner image of first color will be −700 V to −900 V, the potential of the latent image representative of second color will be about −100 V, and the background potential will be about −800 V. The bias for development should be selected such that the toner of first color does not fly into the developing device 7 and, yet, the non-magnetic toner desirably flies toward the latent image of second color. A bias which meets this requisite is a DC or a DC-superposed pulse bias. The toner layer to be used under the above conditions should preferably have an amount of charge Q/M of −5 μC/g to −30 μC/g from the sharpness standpoint and a degree of cohesion of 5% to 30% from the efficient flight standpoint.

The amount of charge of the toner layer deposited on the developing roller 21 is measured by a suction method, i.e., by sucking about 10 mg of toner in a Faraday gauge. Regarding the degree of cohesion, the measurement is effected by use of a powder tester and sequentially setting the following parts on a vibrating table:

(1) vibroshoot
(2) packing
(3) space ring
(4) sieve (three kinds) upper>intermediate>lower
(5) crossbar Such parts are fixed in place by knob nuts, and then the vibrating table is driven.

The measurement is effected under the following conditions:

| | |
|---|---|
| (1) sieve mesh (upper) | 75 μm |
| (2) sieve mesh (intermediate) | 45 μm |
| (3) sieve mesh (lower) | 22 μm |
| (4) amplitude division | 1 mm |
| (5) collected sample | 10 g |
| (6) vibration time | 30 sec |

After the measurement, the degree of cohesion is determined by the following calculations:

$$\frac{\text{weight of powder remained on upper sieve}}{\text{collected amount of sample}} \times 100 \quad \text{(a)}$$

$$\frac{\text{weight of powder remained on intermediate sieve}}{\text{collected amount of sample}} \times 100 \times \frac{5}{3} \quad \text{(b)}$$

$$\frac{\text{weight of powder remained on lower sieve}}{\text{collected amount of sample}} \times 100 \times \frac{1}{5} \quad \text{(c)}$$

The results of the above calculations (a), (b) and (c) is determined to be the degree of cohesion, i.e., $$(a)+(b)+(c)=\text{degree of cohesion } (\%)$$

A toner having a low degree of cohesion as stated above is highly fluid and apt to move on the surface of a toner carrier. It is difficult, therefore, to form two or more layers of such a toner on a toner carrier roller or developing roller having a smooth surface. While a toner carrier roller roughened by sand-blasting is capable of mechanically transporting a toner in multiple layers, it lacks durability since the toner fills the recesses of the roller and solidifies therein. Moreover, it is likely that a toner mechanically transported in multiple layers is scattered around due to the centrifugal force or similar forces.

Figure 5:
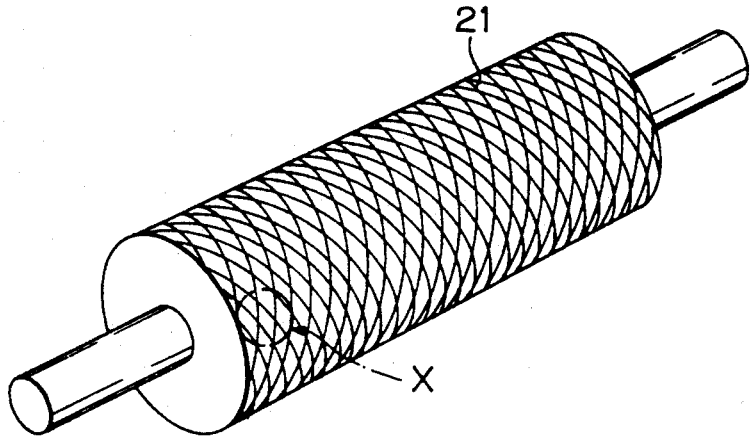
FIG. 5 is a perspective view of a specific configuration of a toner carrier for carrying a single-component toner and representative of an alternative embodiment of the present invention.
Figure 6:
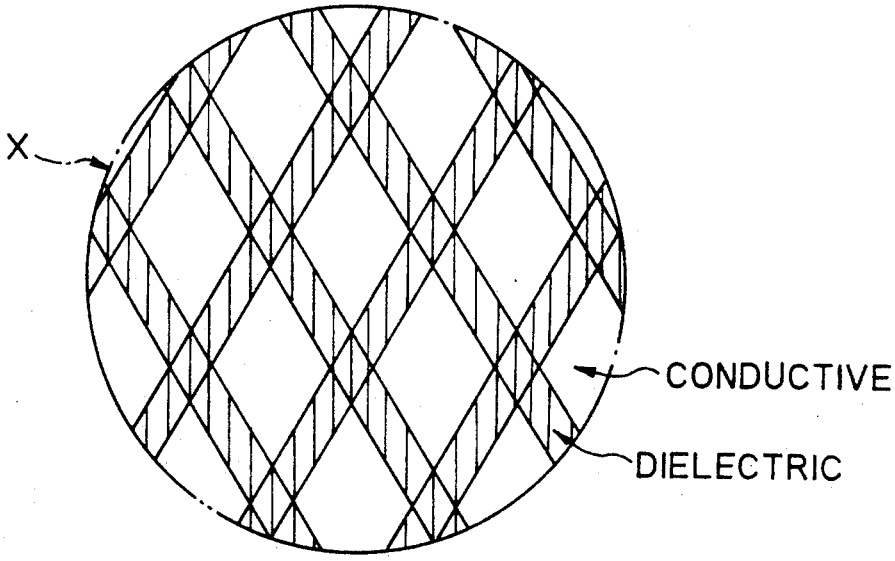
FIG. 6 is an enlarged view of a portion labeled A in FIG. 5.

Taking account of the above-described situation, the present invention uses a roller having the following configuration for carrying non-magnetic toner layers which develop a latent image in the second color. Specifically, the roller has a plurality of portions each having a particular characteristic, and at least one of such portions has a charge holding function. When a charge is applied to the surface of such a roller or the neighborhood thereof, an electric field is developed between the portions having different characteristics so as to retain the toner. More specifically, as shown in FIGS. 5 and 6, a conductive portion and a dielectric portion which are impelemented by aluminum and fluoric resin, respectively, are arranged in a lattice pattern, stripe pattern or any other regular pattern. When a roller having such a configuration is used as the toner carrier roller 21 of the developing device 7, FIG. 2, a charge is accumulated on the dielectric portions of the toner carrier roller 21 due to the friction of the roller 21 with the supply member 22 or with the toner. Since the dielectric portions are surrounded by conductive portions, a great number of microfields are each developed between the neighboring dielectric and conductive portions. As a result, the voltage contrast is enhanced by the peripheral field effect to allow a great amount of toner to be attracted and transported by the coulomb force.

The roller having a great number of small electrodes is capable of forming thereon multiple layers of toner having a degree of cohesion ranging from 5% to 30% and the absolute value of Q/M of 5 μC/g to 30 μC/g, despite the smooth surface thereof. In addition, the toner will be adequately distributed on the roller in a uniform layer if the conductive portions occupy 5% to 60% of the roller surface. So long as the toner is deposited on the roller in such a manner, the bias for development can be implemented only as a DC bias without lowering the sharpness of lines and smooth tonality. Furthermore, even when the drum 1 and toner carrier roller 21 are moved at substantially the same speed, the mass per unit area on the roller (M/A) ranging from 0.5 $mg/cm^2$ to 2.0 $mg/cm^2$ is achievable which insures sufficient image density. This prevents the toner from tending to deposit in a greater amount at the trailing edge of a solid image having a substantial area than at the leading edge.

Of course, the bias for development may be implemented as a DC-superposed pulse bias which prevents the toner of first color from flying into the developing device 7 loaded with the toner of second color.

The alternative embodiment will be described more specifically. The image forming equipment is generally constructed in the same manner as the equipment shown in FIGS. 1 and 2. In FIGS. 1 and 2, the image carrier 1 is constituted by a drum made of an organic photoconductor. The first developing device uses a two-component magnetic brush in developing a latent image in a first color, i.e., black. The second charger 5 again charges the drum 1 on which the black toner image has been formed, the second exposing device 6 forms a second latent image on the drum 1, and then the second developing device 7 develops the latent image in second color. At this instant, the drum potential in the area where the black toner is deposited is −750 V, the potential in the background is −800 V, and the potential in the exposed portion is −100 V. The drum and the toner carrier roller 21 are moved at the same speed of 120 mm/sec. The non-magnetic toner for developing the latent image in the second color has a degree of cohesion of about 20%.

To produce the toner carrier roller 21, the surface of an aluminum pipe is knurled to form 0.2 mm deep and 0.15 mm wide grooves at a pitch of 0.35 mm. The grooves are inclined 45 degrees relative to the longitudinal direction of the aluminum pipe. Fluoric resin such as Lumifron available from Asahi Glass (Japan) is applied to the knurled surface of the aluminum pipe, and then the roller surface is ground, polished or otherwise machined to form conductive portions and dielectric portions each having a small area. The conductive portions occupy about 33% of the surface of the resulting roller. Charges deposited on the dielectric portions generate fringe electric fields which allow the roller surface to hold a toner effectively. At this instant, the toner layers have Q/M of −22 μC/g and M/A of 1.1 mg/cm$^2$. When the roller and drum 1 were moved at the same linear velocity and a bias of DC-750 V was applied for development, a toner of first color was prevented from flying into the developing device 7 and, in addition, an image of second color was free from the concentration of toner at the trailing edge thereof.

In summary, in image forming equipment to which the first-described embodiment of the present invention is applied and of the type transferring a multicolor toner image from a photoconductive element to a recording medium by a single transfer, the developments in the second and successive colors are each implemented by non-contact development using a magnetic toner while a pulse bias is used for development. This is successful in producing a smooth color image. Since non-contact developing using a thin layer of non-magnetic single-component toner is effected with each of the second and successive developments and since the toner layer has Q/M which is 5 $\mu$C/g to 30 $\mu$C/g in absolute value, a clear-cut image is achievable despite the non-contact development. Assume that the toners for effecting the second and successive developments each has the same polarity as a latent image and carries a negative charge. Then, since the pulse bias has an upper voltage range of 0 V to −500 V and a lower voltage range of −500 V to −2000 V and since the frequency is 300 Hz to 2000 Hz, not only the toner of first color is prevented from flying away from the photoconductive element, but also the non-magnetic toner layer whose Q/M ranges from −5 $\mu$C/g to −30 $\mu$C/g can successfully fly. Further, since the lower voltage portion occupies only less than 40%, preferably 30%, of one period of the pulse bias, the toner can fly in matching relation to the field strength to thereby produce a desirable multicolor image. When use is made of a toner which charges to positive polarity, the above-mentioned pulse bias may be provided with a symmetric pattern with respect to the ground potential.

In image forming equipment of the type described and to which the second-desired embodiment is applied, the bias for development is implemented as a DC or a DC-superposed pulse bias to insure a quality color image. The image attainable with this equipment is as sharp as the previous equipment due to the Q/M of toner layer ranging from 5 $\mu$C/g to 30 $\mu$C/g in absolute value. Since the toner has a degree of cohesion ranging from 0.5 mg/cm$^2$ to 2.0 mg/cm$^2$, a sufficiently high image density and a solid image having a uniform density distribution are attainable even when equispeed development is effected with a DC or a DC-superposed pulse bias capable of preventing the toner image of first color from flying away from the photoconductive element being applied. Since the toner carrier roller for effecting any of the second and successive developments retains the toner due to an electric field developed between different portions thereof, the toner layer on the roller can have M/A of 0.5 mg/cm$^2$ to 2.0 mg/cm$^2$ even when use is made of a highly fluid toner whose degree of cohesion is 5 to 30%. Hence, not only sufficiently high image density but also a uniform solid image are achievable despite the equispeed development, as stated above. The toner carrier roller for any of the second and successive developments may have conductive portions and dielectric portions in a regular pattern thereon, the conductive portions occupying 5% to 60% of the roller surface. Then, desirable multiple toner layers can be formed due to the peripheral field effect of the charges deposited on the dielectric portions. This is also successful in insuring sufficient image density and a solid image having a uniform density distribution.

Various modifications will become possible for those skilled in the art after receiving the teachings of the present disclosure without departing from the scope thereof.

What is claimed is:

1. Color image forming equipment for transferring a multicolor image from an image carrier to a recording medium by a single transfer, comprising:

first exposing means for electrostatically forming a first latent image on said image carrier;

first developing means for developing said first latent image;

second exposing means for electrostatically forming a second latent image on said image carrier carrying a toner image produced by said first developing means; and second developing means comprising a toner carrier for developing said second latent image;

said second developing means effecting development without contacting said image carrier and by use of a non-magnetic one-component toner layer formed on said toner carrier, a pulse bias being applied to said second developing means as a bias for development, wherein said non-magnetic one-component toner layer which said second developing means uses has an amount of charge per unit mass of 5 $\mu$C/g to 30 $\mu$C/g in absolute value, and an amount of non-magnetic one-component toner layer deposition on said toner carrier per unit area ranges from 0.5 mg/cm$^2$ to 2.0 mg/cm$^2$.

2. Equipment as claimed in claim 1, wherein when said non-magnetic one-component toner layer to be used by said second developing means has a same polarity as the first and second latent images and has a negative charge, said pulse bias is made up of an upper voltage portion ranging from 0 V to −500 V and a lower voltage portion ranging from −500 V to −2000 V, said lower voltage portion occupying less than 40% of one period, a frequency ranging from 300 Hz to 2000 Hz, and wherein said pulse bias being symmetric with respect to ground potential when said non-magnetic one-component toner layer has a positive charge.

3. Equipment as claimed in claim 1, wherein said pulse bias comprises a DC or a DC-superposed pulse bias.

4. Equipment as claimed in claim 3, wherein said non-magnetic one-component toner layer has a degree of cohesion ranging from 5% to 30%.

5. Equipment as claimed in claim 4, wherein said toner carrier comprises a plurality of portions each having a particular characteristic and at least one of which has a charge holding function, said non-magnetic one-component toner layer being held by an electric field developed between said portions having different characteristics when a charge is applied to a surface of said toner carrier or a neighborhood of said surface.

6. Color image forming equipment for transferring a multicolor image from an image carrier to a recording medium by a single transfer, comprising:

first exposing means for electrostatically forming a first latent image on said image carrier;

first developing means for developing said first latent image;

second exposing means for electrostatically forming a second latent image on said image carrier carrying a toner image produced by said first developing means and having a first potential; and second developing means comprising a toner carrier for developing said second latent image;

said second developing means effecting development without contacting said image carrier and by use of a one-component toner layer formed on said toner carrier, a pulse bias being applied to said second developing means as a bias for development, wherein when said one-component toner layer to be used by said second developing means has a same polarity as the first and second latent images and has a negative charge, the pulse bias has a second potential made up of first and second voltage portions, the first voltage portion being higher than the first potential and a background potential of the image carrier and the second voltage portion being lower than the first potential and the background potential, wherein said second voltage portion occupies less than 40% of one period.

7. Equipment as claimed in claim 6, wherein said first voltage portion ranges from 0 V to −500 V and the second voltage portion ranges from −500 V to −2000 V.

8. Equipment as claimed in claim 7, wherein said pulse bias has a frequency ranging from 300 Hz to 2000 Hz.

9. Equipment as claimed in claim 8, wherein said one-component toner layer has a positive charge, a degree of cohesion ranging from 5% to 30% and an amount of deposition on said toner carrier per unit area ranging from 0.5 $mg/cm^2$ to 2-0 $mg/cm^2$.

10. Equipment as claimed in claim 8, wherein when said one-component toner layer has a positive charge, said pulse bias is symmetric with respect to the background potential.

* * * * *